US010564586B2

(12) United States Patent
Osawa et al.

(10) Patent No.: US 10,564,586 B2
(45) Date of Patent: Feb. 18, 2020

(54) IMAGE FORMING APPARATUS AND IMAGE FORMING METHOD

(71) Applicant: Oki Data Corporation, Tokyo (JP)

(72) Inventors: Yumi Osawa, Tokyo (JP); Toshihiro Shimanuki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 16/359,262

(22) Filed: Mar. 20, 2019

(65) Prior Publication Data

US 2019/0302672 A1 Oct. 3, 2019

(30) Foreign Application Priority Data

Mar. 30, 2018 (JP) ..... 2018-067721

(51) Int. Cl.
*G03G 15/00* (2006.01)

(52) U.S. Cl.
CPC ..... *G03G 15/6523* (2013.01); *G03G 15/553* (2013.01); *G03G 15/556* (2013.01)

(58) Field of Classification Search
CPC . G03G 15/6523; G03G 15/553; G03G 15/556
See application file for complete search history.

(56) References Cited

U.S. PATENT DOCUMENTS

2010/0158549 A1 6/2010 Shiraishi
2011/0211009 A1 9/2011 Fujinaga

FOREIGN PATENT DOCUMENTS

JP 2004-094554 * 3/2004
JP 2008087386 A 4/2008
JP 2008-123166 * 5/2008

OTHER PUBLICATIONS

Annex to European Search Report dated Aug. 14, 2019 in EP 19162241.

* cited by examiner

*Primary Examiner* — Hoang X Ngo
(74) *Attorney, Agent, or Firm* — Panitch Schwarze Belisario & Nadel LLP

(57) ABSTRACT

An image forming apparatus includes a cutter, an image forming section, and a controller. The cutter performs cutting of a print medium on the basis of a cutting instruction. The image forming section performs, on the basis of print data, image formation on the print medium with use of a consumable material. The controller calculates, on the basis of the print data, an estimated use amount on the basis of a section page group as a unit, and determines, on the basis of the estimated use amount and a usable amount, whether the image forming section is able to use the consumable material. The section page group is a page group, of the print medium, sectioned in accordance with the cutting instruction. The estimated use amount is an amount of the consumable material to be used. The usable amount is a remaining amount of the consumable material that is usable.

12 Claims, 12 Drawing Sheets

| CASE | CUTTING COMMAND CMD | NOTIFICATION MODE MD | PAGE INFORMATION INFP | | JOB INFORMATION INFJ |
|---|---|---|---|---|---|
| | | | YES/NO | CONTENTS | |
| C1 | YES | ENABLED (CONFIRM WHETHER TONER IS SUFFICIENT EACH TIME CUTTING IS PERFORMED, AND NOTIFY USER OF RESULT OF CONFIRMATION) | YES | INFPA: ACCUMULATED USE AMOUNT TU2 (ACCUMULATED USE AMOUNT OF TONER UP TO RELEVANT PAGE IN RELEVANT JOB)<br>INFPB: PAGE NUMBER PN (NUMBER OF PAGES IN SECTIONED PAGE GROUP SEG INCLUDING RELEVANT PAGE) | INFJ1: TOTAL PAGE COUNT PCA (NUMBER OF PAGES IN TOTAL IN RELEVANT JOB)<br>INFJ2: TOTAL CUTTING COUNT CCA (NUMBER OF CUTTING IN TOTAL IN RELEVANT JOB)<br>INFJ3: 0 |
| C2 | YES | DISABLED (CONFIRM WHETHER TONER IS SUFFICIENT BEFORE IMAGE FORMATION IS STARTED, AND NOTIFY USER OF RESULT OF CONFIRMATION) | YES | INFPA: ACCUMULATED USE AMOUNT TU2 (ACCUMULATED USE AMOUNT OF CONSUMABLE MATERIAL UP TO RELEVANT PAGE IN RELEVANT JOB)<br>INFPB: PAGE NUMBER PN (NUMBER OF PAGES IN SECTIONED PAGE GROUP SEG INCLUDING RELEVANT PAGE) | INFJ1: TOTAL PAGE COUNT PCA (NUMBER OF PAGES IN TOTAL IN RELEVANT JOB)<br>INFJ2: TOTAL CUTTING COUNT CCA (NUMBER OF CUTTING IN TOTAL IN RELEVANT JOB)<br>INFJ3: TOTAL USE AMOUNT TUA (AMOUNT OF TONER TO BE USED IN TOTAL IN RELEVANT JOB) |
| C3 | NO | — | NO | — | INFJ1: TOTAL PAGE COUNT PCA (NUMBER OF PAGES IN TOTAL IN RELEVANT JOB)<br>INFJ2: 0<br>INFJ3: TOTAL USE AMOUNT TUA (AMOUNT OF TONER TO BE USED IN TOTAL IN RELEVANT JOB) |

FIG. 4

P201

PRINTING.

PAGE 2/3

FIG. 6

P202

CYAN TONER MAY RUN OUT BEFORE COMPLETION OF PRINTING OF PAGE 3. REPLACE THE TONER CARTRIDGE OR PRESS THE CANCEL BUTTON TO CANCEL THE JOB.

FIG. 7

P203

PRINTING.

PAGE 21/90

FIG. 8

P204

CYAN TONER MAY RUN OUT BEFORE COMPLETION OF PRINTING OF PAGE 90. REPLACE THE TONER CARTRIDGE OR PRESS THE CANCEL BUTTON TO CANCEL THE JOB.

FIG. 9

P205

PRINTING.

CUT 6/29
PAGE 2/3

FIG. 10

P206

CYAN TONER MAY RUN OUT BEFORE COMPLETION OF PRINTING OF CUTTING 6/29.
REPLACE THE TONER CARTRIDGE, PRESS THE OK BUTTON TO CONTINUE PRINTING, OR PRESS THE CANCEL BUTTON TO CANCEL THE JOB.

FIG. 11

IMAGE FORMING APPARATUS AND IMAGE FORMING METHOD

CROSS REFERENCE TO RELATED APPLICATIONS

The present application claims priority from Japanese Patent Application No. 2018-067721 filed on Mar. 30, 2018, the entire contents of which are hereby incorporated by reference.

BACKGROUND

The technology relates to an image forming apparatus that forms an image and to an image forming method.

Some image forming apparatuses are able to form an image, for example, on a long print medium such as a roll of paper or a roll of any other printable material. For example, Japanese Unexamined Patent Application Publication No. 2008-87386 discloses an image forming apparatus that detects a remaining amount of ink before and after a print job and a remaining amount of a roll of paper before and after the print job. Further, the image forming apparatus thereby calculates a use amount of the ink for the print job and a use amount of the roll of paper for the job. The image forming apparatus determines, when performing the print job again, whether the ink and the roll of paper are sufficient on the basis of the calculated use amount of the ink and the calculated use amount of the roll of paper.

SUMMARY

It is desired that an image forming apparatus allow effective utilization of a consumable material without uselessly using the consumable material.

It is desirable to provide an image forming apparatus and an image forming method that each allow for effective utilization of a consumable material.

According to one embodiment of the technology, there is provided an image forming apparatus that includes a cutter, an image forming section, and a controller. The cutter performs cutting of a print medium on the basis of a cutting instruction. The image forming section performs, on the basis of print data, image formation on the print medium with use of a consumable material. The controller calculates, on the basis of the print data, an estimated use amount on the basis of a section page group as a unit, and determines, on the basis of the estimated use amount and a usable amount, whether the image forming section is able to use the consumable material. The section page group is a page group, of the print medium, sectioned in accordance with the cutting instruction. The estimated use amount is an amount of the consumable material that is estimated to be used. The usable amount is a remaining amount of the consumable material that is usable.

According to one embodiment of the technology, there is provided an image forming method including: cutting, with a cutter, a print medium on the basis of a cutting position; calculating, with a controller, on the basis of print data, an estimated use amount on the basis of a section page group as a unit, the estimated use amount being an amount of a consumable material that is estimated to be used, the section page group being a page group, of the print medium, sectioned in accordance with the cutting position; determining, on the basis of the estimated use amount and a usable amount, whether an image forming section is able to use the consumable material, the usable amount being a remaining amount of the consumable material that is usable; and performing, with the image forming section, image formation on the print medium with use of the consumable material on the basis of the print data.

BRIEF DESCRIPTION OF DRAWINGS

FIG. 4 is a table illustrating an example of a configuration of page information and job information both generated by the image forming apparatus illustrated in FIG. 1.

FIG. 6 is a diagram illustrating an example of an image to be displayed on a display operation section illustrated in FIG. 2.

FIG. 7 is another diagram illustrating an example of an image to be displayed on the display operation section illustrated in FIG. 2.

FIG. 8 is still another diagram illustrating an example of an image to be displayed on the display operation section illustrated in FIG. 2.

FIG. 9 is still another diagram illustrating an example of an image to be displayed on the display operation section illustrated in FIG. 2.

FIG. 10 is still another diagram illustrating an example of an image to be displayed on the display operation section illustrated in FIG. 2.

FIG. 11 is still another diagram illustrating an example of an image to be displayed on the display operation section illustrated in FIG. 2.

DETAILED DESCRIPTION

Figure 1:
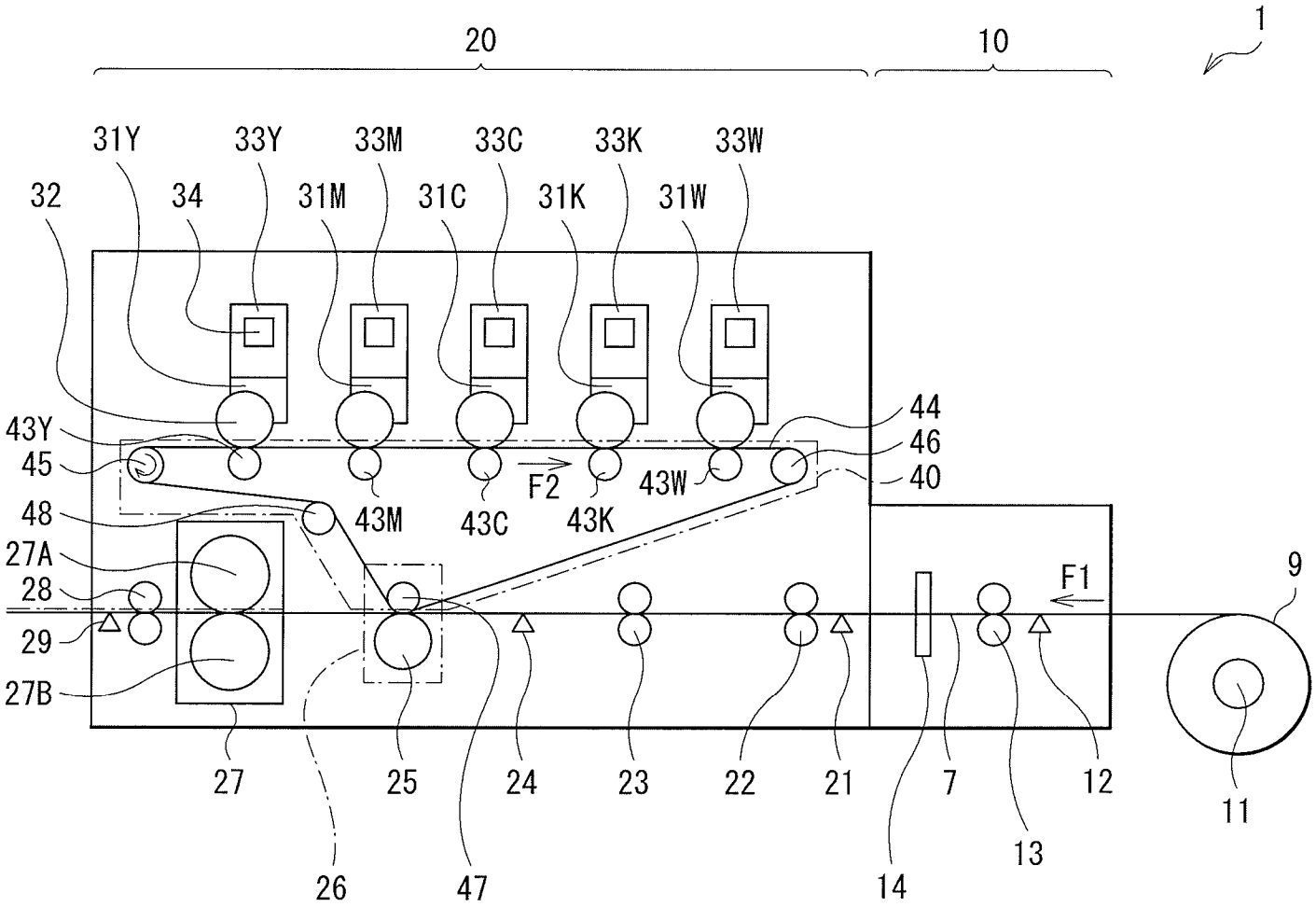
FIG. 1 is a diagram illustrating an example of a configuration of an image forming apparatus according to one example embodiment of the technology.

Hereinafter, some example embodiments of the technology will be described in detail with reference to the drawings. Note that the following description is directed to illustrative examples of the technology and not to be construed as limiting to the technology. Factors including, without limitation, numerical values, shapes, materials, components, positions of the components, and how the components are coupled to each other are illustrative only and not to be construed as limiting to the technology. Further, elements in the following example embodiments which are not recited in a most-generic independent claim of the technology are optional and may be provided on an as-needed basis. The drawings are schematic and are not intended to be drawn to scale. Note that the like elements are denoted with the same reference numerals, and any redundant description thereof will not be described in detail.

Example Embodiment

Configuration Example

FIG. 1 illustrates an example of a configuration of an image forming apparatus 1, i.e., an image forming apparatus according to an example embodiment of the technology. The image forming apparatus 1 may serve as a printer that forms an image on a so-called roll of paper by an electrophotographic method, for example. It is to be noted that an image forming method according to an example embodiment of the technology is implemented by the following example embodiment, and is therefore described together. The image forming apparatus 1 may include a print medium feeding section 10 and an image forming section 20.

The print medium feeding section 10 may take out a print medium 9 from a roll of the print medium 9 and feed the taken-out print medium 9 to the image forming section 20. The print medium feeding section 10 may include a print medium holder 11, a print medium sensor 12, a conveying roller 13, and a cutter 14. The print medium holder 11, the print medium sensor 12, the conveying roller 13, and the cutter 14 may be disposed in this order along a conveyance path 7 in a conveyance direction F1. The conveyance direction F1 may be a direction in which the print medium 9 is to be conveyed.

The print medium holder 11 may hold the roll of print medium 9 in a rotatable manner.

The print medium sensor 12 may detect the print medium 9. The print medium sensor 12 may detect that the print medium 9 is being fed from the print medium holder 11.

The conveying roller 13 may include a pair of rollers that are disposed with the conveyance path 7 in between. The conveying roller 13 may take out the print medium 9 from the roll of the print medium 9 held by the print medium holder 11 and convey the taken-out print medium 9 along the conveyance path 7.

The cutter 14 may cut the print medium 9 on the basis of an instruction given from an image formation controller 54 which will be described later.

The image forming section 20 may form an image on the print medium 9 fed from the print medium feeding section 10. The image forming section 20 may include five image forming units 31, five toner containers 33, a belt section 40, a print medium sensor 21, a conveying roller 22, a conveying roller 23, a print medium sensor 24, a secondary transfer roller 25, a fixing section 27, a discharging roller 28, and a discharging sensor 29. The five image forming units 31 may include image forming units 31Y, 31M, 31C, 31K, and 31W. The five toner containers 33 may include toner containers 33Y, 33M, 33C, 33K, and 33W.

The five image forming units 31 may each form a toner image. For example, the image forming unit 31Y may form a toner image of yellow (Y). The image forming unit 31M may form a toner image of magenta (M). The image forming unit 31C may form a toner image of cyan (C). The image forming unit 31K may form a toner image of black (K). The image forming unit 31W may form a toner image of white (W). The image forming units 31Y, 31M, 31C, 31K, and 31W may be disposed in this order in a conveyance direction F2. The conveyance direction F2 may be a direction in which a transfer belt 44 is to be conveyed. The transfer belt 44 will be described later. Each of the image forming units 31 may have an attachable and detachable configuration.

Each of the five image forming units 31 may include a photosensitive member 32. A surface of each of the photosensitive members 32 may be subjected to exposure by a corresponding exposure unit which is not illustrated. Thereby, an electrostatic latent image may be formed on the surface of each of the photosensitive members 32. Thereafter, a toner may be fed on the surface of each of the photosensitive members 32. Thereby, a toner image based on the electrostatic latent image may be formed on the surface of each of the photosensitive members 32. In other words, development may be performed on the surface of each of the photosensitive members 32.

Each of the five toner containers 33 may contain a toner. For example, the toner container 33Y may contain a yellow toner. The toner container 33M may contain a magenta toner. The toner container 33C may contain a cyan toner. The toner container 33K may contain a black toner. The toner container 33W may contain a white toner. Each of the five toner containers 33 may feed the toner to corresponding one of the five image forming units 31. Each of the five toner containers 33 may have a configuration that is attachable to and detachable from the corresponding one of the five image forming units 31.

Each of the five toner containers 33 may include an integrated circuit (IC) tag 34. The IC tag 34 may hold information related to, for example but not limited to, an identification number of the toner container 33, the color of the toner in the toner container 33, and a remaining amount of the toner in the toner container 33. The information held by the IC tag 34 may be read, for example, via an information reader 55 by means of communication such as wired communication or wireless communication. The information reader 55 will be described later.

The belt section 40 may include five primary transfer rollers 43, the transfer belt 44, a drive roller 45, an idle roller 46, a secondary transfer back-up roller 47, and an idle roller 48. The five primary transfer rollers 43 may include primary transfer rollers 43Y, 43M, 43C, 43K, and 43W.

The five primary transfer rollers 43 may each electrostatically transfer, onto a transfer surface of the transfer belt 44, the toner image formed by corresponding one of the five image forming units 31. The primary transfer roller 43Y may face the photosensitive member 32 of the image forming unit 31Y with the transfer belt 44 in between. The primary transfer roller 43M may face the photosensitive member 32 of the image forming unit 31M with the transfer belt 44 in between. The primary transfer roller 43C may face the photosensitive member 32 of the image forming unit 31C with the transfer belt 44 in between. The primary transfer roller 43K may face the photosensitive member 32 of the image forming unit 31K with the transfer belt 44 in between. The primary transfer roller 43W may face the photosensitive member 32 of the image forming unit 31W with the transfer belt 44 in between. Each of the primary transfer rollers 43 may receive a predetermined primary transfer voltage. Thereby, the toner image formed by each of the image forming units 31 may be transferred onto the transfer surface of the transfer belt 44 in the image forming apparatus 1. In other words, primary transfer may be thereby performed in the image forming apparatus 1.

The transfer belt 44 may support the toner image on its transfer surface, and convey the toner image toward a secondary transfer section 26 which will be described later. The transfer belt 44 may be an elastic endless belt including, for example, a high-resistance electrically-semiconductive plastic film. The transfer belt 44 may lie on the drive roller 45, the idle roller 46, the secondary transfer back-up roller 47, and the idle roller 48 while being stretched. The transfer belt 44 may be circularly conveyed in accordance with rotation of the drive roller 45.

The drive roller 45 may cause the transfer belt 44 to be circularly conveyed. In this example, the drive roller 45 may be disposed upstream of the five image forming units 31 in the conveyance direction F2 of the transfer belt 44. In this example, the drive roller 45 may rotate clockwise with power transmitted from an unillustrated transfer belt motor. The drive roller 45 may thereby circularly convey the transfer belt 44 in the conveyance direction F2.

The idle roller 46 may be rotated in accordance with the circular conveyance of the transfer belt 44. The idle roller 46 may be rotated clockwise in this example. In this example, the idle roller 46 may be disposed downstream of the five image forming units 31 in the conveyance direction F2 of the transfer belt 44.

The secondary transfer back-up roller 47 may be rotated in accordance with the circular conveyance of the transfer belt 44. The secondary transfer back-up roller 47 may be rotated clockwise in this example. The secondary transfer back-up roller 47 may face the secondary transfer roller 25 with the conveyance path 7 and the transfer belt 44 in between. The secondary transfer back-up roller 47 and the secondary transfer roller 25 may be included together in the secondary transfer section 26.

The idle roller 48 may be rotated in accordance with the circular conveyance of the transfer belt 44. The idle roller 48 may be rotated counterclockwise in this example. The idle roller 48 may be disposed downstream of the secondary transfer section 26 in the conveyance direction F2 of the transfer belt 44.

The print medium sensor 21 may detect the print medium 9. The print medium sensor 21 may detect that the print medium 9 is being fed from the print medium feeding section 10.

The conveying roller 22 may include a pair of rollers that are disposed with the conveyance path 7 in between. The conveying roller 22 may convey, along the conveyance path 7, the print medium 9 fed from the print medium feeding section 10.

The conveying roller 23 may include a pair of rollers that are disposed with the conveyance path 7 in between. The conveying roller 23 may convey the print medium 9, fed from the conveying roller 22, along the conveyance path 7 toward the secondary transfer section 26.

The print medium sensor 24 may detect the print medium 9. The print medium sensor 24 may be directed to adjusting a writing position on the print medium 9 when the secondary transfer section 26 transfers the toner image onto the print medium 9.

The secondary transfer roller 25 may transfer, onto the print medium 9, the toner image on the transfer surface of the transfer belt 44. The secondary transfer roller 25 may face the secondary transfer back-up roller 47 with the conveyance path 7 and the transfer belt 44 in between. The secondary transfer roller 25 and the secondary transfer back-up roller 47 may be included together in the secondary transfer section 26. The secondary transfer roller 25 may receive a predetermined secondary transfer voltage. This allows, in the image forming apparatus 1, the toner image on the transfer surface of the transfer belt 44 to be transferred onto the print medium 9. In other words, this allows secondary transfer to be performed.

The fixing section 27 may apply heat and pressure to the print medium 9, and thereby fix, to the print medium 9, the toner image transferred onto the print medium 9. The fixing section 27 may include a heating roller 27A and a pressure applying roller 27B. The heating roller 27A may include a heater such as a halogen lamp inside the heating roller 27A. The heating roller 27A may apply heat to the toner on the print medium 9. The pressure applying roller 27B may be so disposed that a pressure-contact is provided between the pressure applying roller 27B and the heating roller 27A. The pressure applying roller 27B may apply pressure to the toner on the print medium 9. Thereby, the toner on the print medium 9 may be heated, melted, and applied with pressure in the fixing section 27. As a result, the toner image may be fixed to the print medium 9.

The discharging roller 28 may include a pair of rollers that are disposed with the conveyance path 7 in between. The discharging roller 28 may convey the print medium 9 toward outside of the image forming apparatus 1.

The discharging sensor 29 may detect discharge of the print medium 9.

Figure 2:
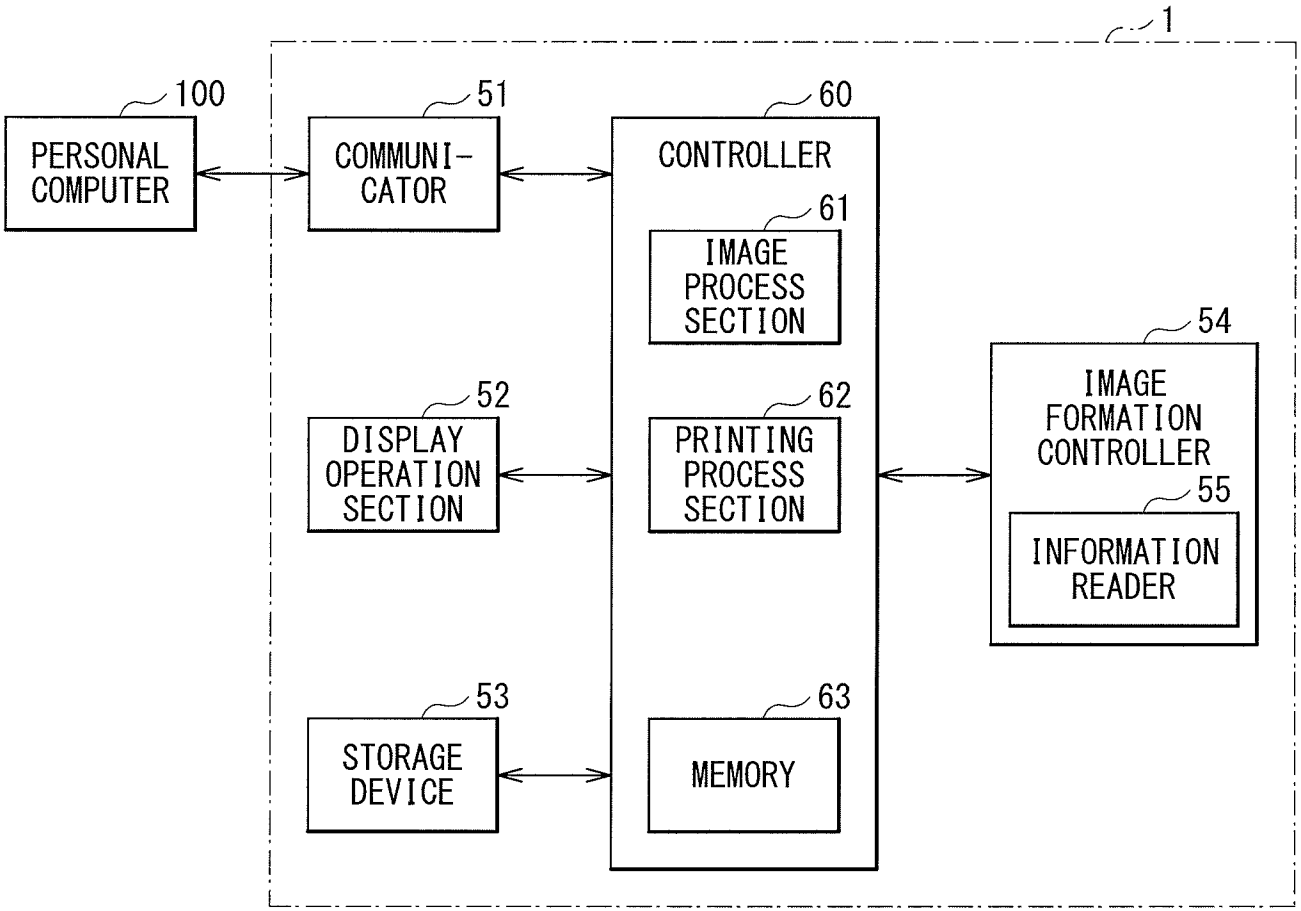
FIG. 2 is a block diagram illustrating an example of a control mechanism of an image forming apparatus illustrated in FIG. 1.

FIG. 2 illustrates an example of a control mechanism of the image forming apparatus 1. The image forming apparatus 1 may include a communicator 51, a display operation section 52, a storage device 53, the image formation controller 54, and a controller 60.

The communicator 51 may perform communication with a host device. The host device may be a personal computer 100 in this example. The communicator 51 may receive print data DP supplied from the personal computer 100. The communicator 51 may be coupled to the personal computer 100 by means of, for example but not limited to, a network such as a local area network (LAN) or an interface such as a universal serial bus (USB). The print data DP may include, for example but not limited to, image data DT corresponding to a plurality of pages. Further, in a case where the print medium 9 is to be cut by the image forming apparatus 1, the print data DP may include a cutting command CMD. The cutting command CMD may be provided at the top of the print data DP. The cutting command CMD may include information related to the number of pages on the basis of which single cutting of the print medium 9 is to be performed. For example, in a case where the cutting command CMD instructs to cut the print medium 9 for every three pages, the image forming apparatus 1 may generate a single cutting instruction INS for every three pages on the basis of the foregoing cutting command CMD.

The display operation section 52 may receive operation performed by a user. Further, the display operation section 52 may display information such as an operation state of the image forming apparatus 1. The display operation section 52 may include, for example, components such as a touch panel, various buttons, a liquid crystal display, or various indicators.

The storage device 53 may have a large storage capacity, for example. The storage device 53 may include, for example but not limited to, a non-volatile semiconductor memory and a hard disk drive. The storage device 53 may hold image data DT2, information related to a setting of the image forming apparatus 1, i.e., an apparatus setting, or any other storable information. The image data DT2 may have been subjected to an editing process and an expanding process by the controller 60. The apparatus setting may include a setting of a notification mode MD in a case where the print data DP includes the cutting command CMD. The setting of the notification mode MD may be a setting that instructs which timing to notify the user of a matter related to the consumable material. The consumable material described above may be the toner container 33, in this example. For example, in a case where the notification mode MD is "enabled", the image forming apparatus 1 may confirm whether the toner is sufficient each time the cutter 14 performs cutting of the print medium 9. Further, the image forming apparatus 1 may display a result of the confirmation on the display operation section 52. In a case where the notification mode MD is "disabled", the image forming apparatus 1 may confirm whether the toner is sufficient before image formation on the print medium 9 is started. Further, the image forming apparatus 1 may display a result of the confirmation on the display operation section 52. The storage device 53 may hold information related to the above-described setting of the notification mode MD.

The image formation controller 54 may control operation of the print medium feeding section 10 and the image forming section 20 both illustrated in FIG. 1. The image formation controller 54 may include an information reader 55. The information reader 55 may read information from the IC tag 34 of each of the five toner containers 33, or write information on the IC tag 34 of each of the five toner containers 33.

The controller 60 may control operation of the image forming apparatus 1. The controller 60 may include, for example but not limited to, a central processing unit (CPU), a random access memory (RAM), and a non-volatile semiconductor memory. The controller 60 may include an image process section 61, a printing process section 62, and a memory 63.

The image process section 61 may generate the image data DT2 by performing an image process on the basis of image data DT. The image process may include an editing process and an expanding process. The image data DT may be included in the print data DP supplied from the personal computer 100. Further, the image process section 61 may store the generated image data DT2 in the storage device 53. The image process section 61 may also submit a job to a print queue on the basis of the notification mode MD.

The printing process section 62 may control a printing process in the image forming apparatus 1 by giving an instruction to the image formation controller 54. The printing process section 62 may also confirm whether the toner is sufficient on the basis of the print data DP, in accordance with the notification mode MD. For example, in a case where the notification mode MD is "enabled", the printing process section 62 may confirm whether the toner is sufficient each time the cutter 14 performs cutting of the print medium 9. In a case where the notification mode MD is "disabled", the printing process section 62 may confirm whether the toner is sufficient before the image formation on the print medium 9 is started. When the toner is not sufficient, the printing process section 62 may calculate a cuttable time number. The cuttable time number may be the number of times that the print medium 9 is cuttable before the toner becomes insufficient.

The memory 63 may temporarily hold various pieces of information to be used upon the operation of the image forming apparatus 1. The memory 63 may include a RAM. The memory 63 may hold, for example but not limited to, a print queue in which information related to a print job is to be stored.

The cutter 14 may correspond to a "cutter" in one specific but non-limiting embodiment of the technology. The image forming section 20 may correspond to an "image forming section" in one specific but non-limiting embodiment of the technology. The toner container 33 may correspond to a "consumable material" in one specific but non-limiting embodiment of the technology. The controller 60 may correspond to a "controller" in one specific but non-limiting embodiment of the technology. The display operation section 52 may correspond to a "notifying section" in one specific but non-limiting embodiment of the technology. The cutting instruction INS may correspond to a "cutting instruction" in one specific but non-limiting embodiment of the technology. The cutting command CMD may correspond to "control information" in one specific but non-limiting embodiment of the technology. A toner remaining amount TR may correspond to a "usable amount" in one specific but non-limiting embodiment of the technology.

Operation and Example Workings

A description is given next of operation and example workings of the image forming apparatus 1 of the example embodiment.

[Overview of General Operation]

A description is first given of an overview of general operation of the image forming apparatus 1 with reference to FIGS. 1 and 2. When the communicator 51 receives the print data DP supplied from the personal computer 100, the image process section 61 may generate the image data DT2 by performing an image process on the basis of the image data DT included in the print data DP. Further, the image process section 61 may store the generated image data DT2 in the storage device 53. The printing process section 62 may give an instruction to the image formation controller 54 on the basis of the image data DT2 stored in the storage device 53. The image formation controller 54 may control the operation of the print medium feeding section 10 and the operation of the image forming section 20 on the basis of the instruction given from the printing process section 62. The print medium feeding section 10 may take out the print medium 9 from the roll of the print medium 9 and feed the taken-out print medium 9 to the image forming section 20, on the basis of the instruction given from the image formation controller 54. The cutter 14 of the print medium feeding section 10 may perform cutting of the print medium 9 in accordance with the cutting command CMD included in the print data DP, on the basis of the instruction given from the image formation controller 54. The image forming section 20 may form, on the basis of the instruction given from the image formation controller 54, an image on the print medium 9 fed from the print medium feeding section 10.

[Detailed Operation]

The image process section 61 may generate the image data DT2 by performing the image process on the basis of the image data DT included in the print data DP. The image process section 61 may also submit a job to a print queue. The printing process section 62 may perform a printing process on the basis of the information submitted to the print queue and the image data DT2. This operation is described below in detail. In the following, consideration is given to three cases C1 to C3. In the case C1, the print data DP includes the cutting command CMD, and the notification mode MD is set to be "enabled". The cutting command CMD may be a command directed to the cutting of the print medium 9. In the case C2, the print data DP includes the cutting command CMD, and the notification mode MD is set to be "disabled". In the case C3, the print data DP does not include the cutting command CMD. In the following, for the sake of simple description, attention is paid to one of the five toner containers 33. The one of the five toner containers 33 to which attention is paid may be referred to as the "toner container 33 of interest" hereinafter. A description is given, as an example, of a consumed amount of the toner in the toner container 33 of interest.

[Operation of Image Process Section 61]

Figure 3A:
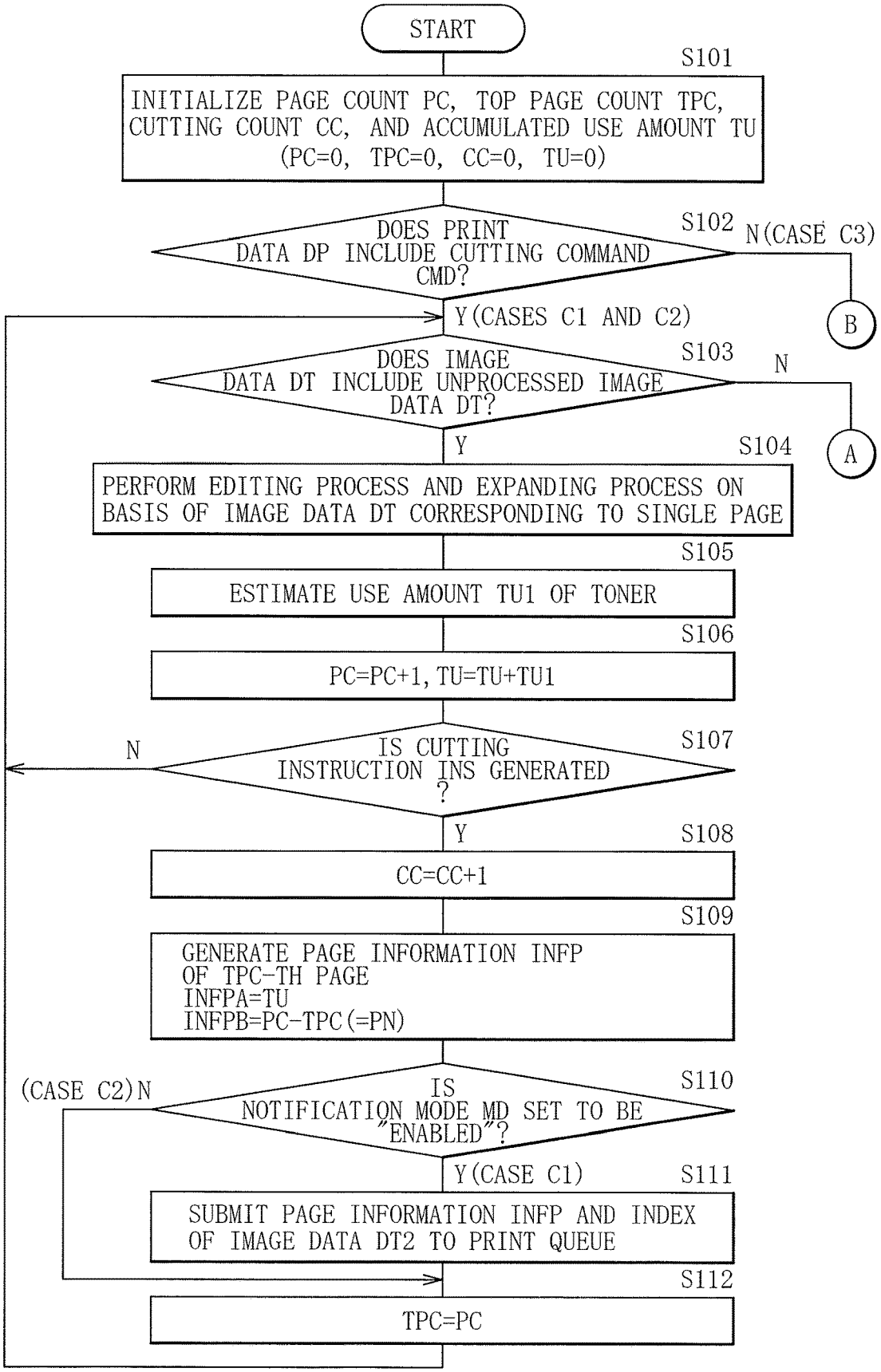
FIG. 3A is a flowchart illustrating an example of operation of an image process section illustrated in FIG. 2.
Figure 3B:
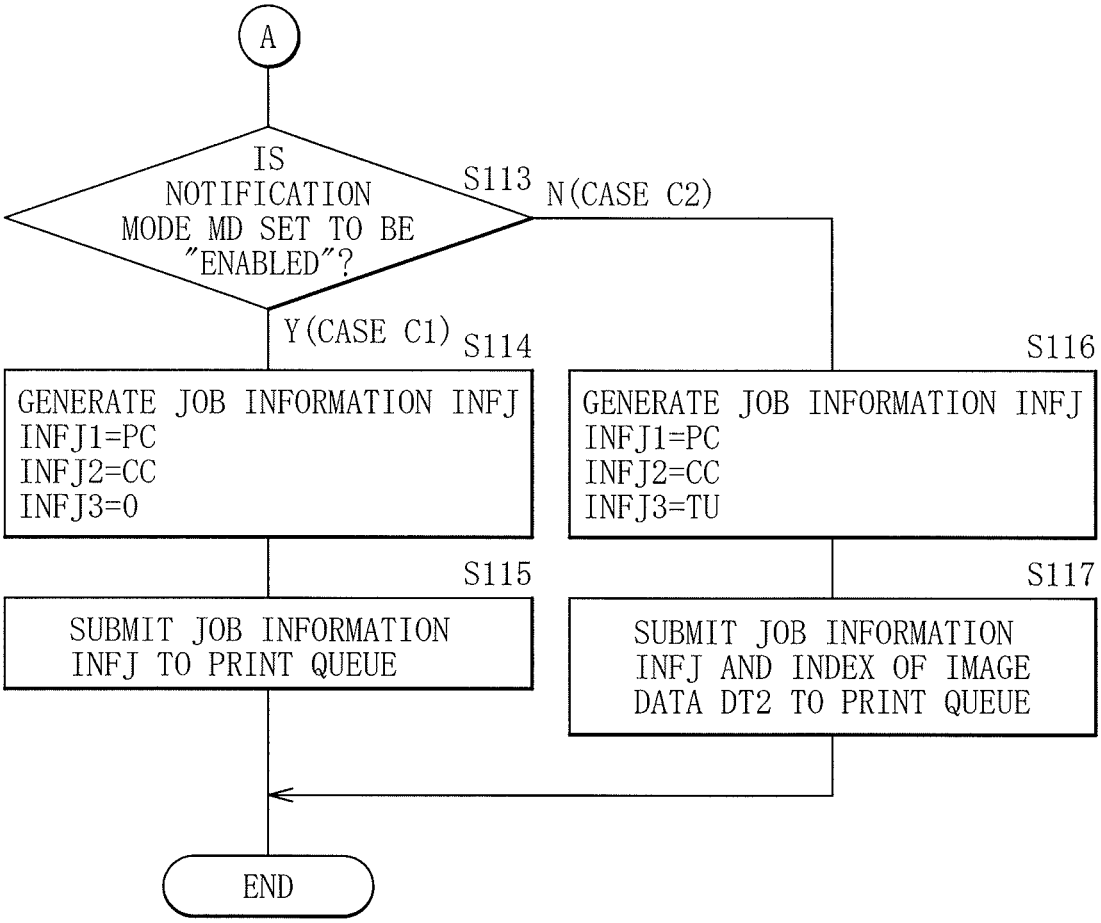
FIG. 3B is another flowchart illustrating an example of the operation of the image process section illustrated in FIG. 2.
Figure 3C:
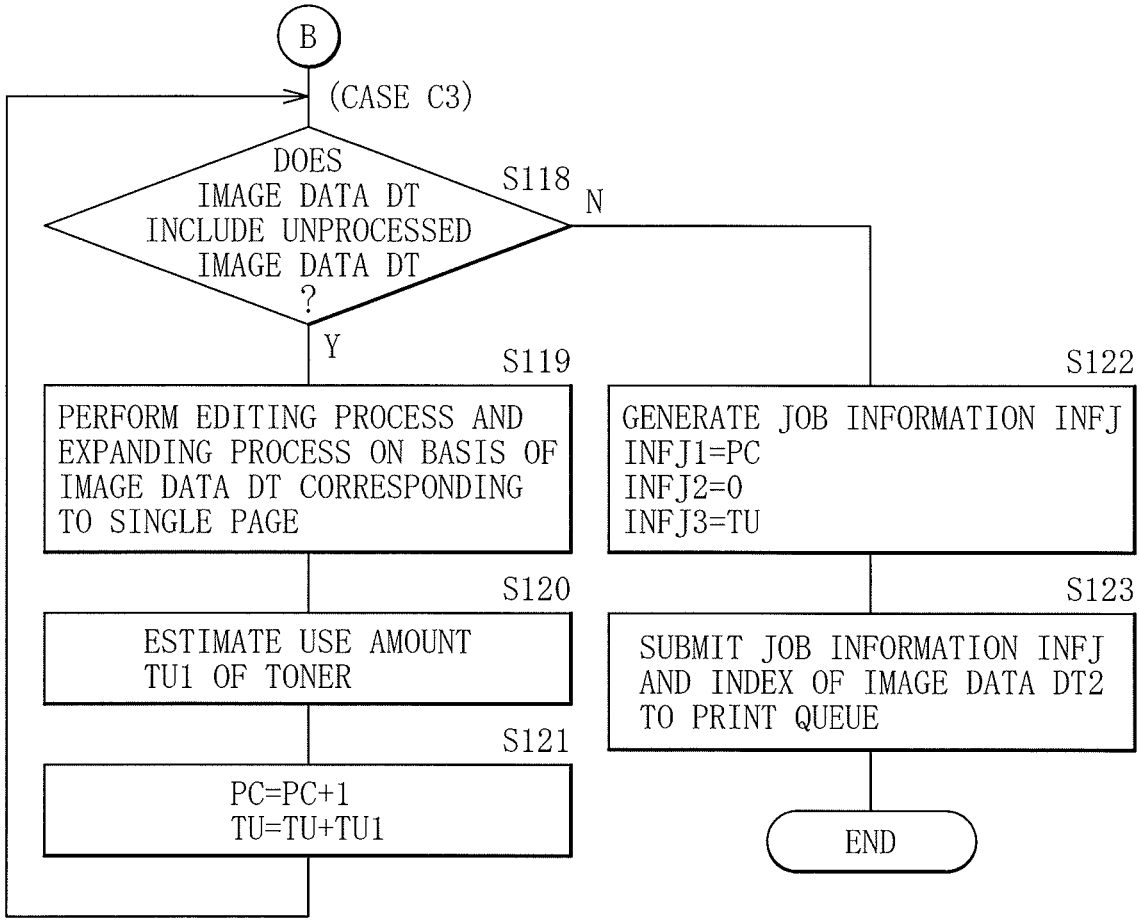
FIG. 3C is still another flowchart illustrating an example of the operation of the image process section illustrated in FIG. 2.

FIGS. 3A to 3C illustrate an example of operation of the image process section 61. When the communicator 51 receives the print data DP supplied from the personal computer 100, the image process section 61 may generate the image data DT2 by performing an image process on the basis of the image data DT included in the print data DP. The image process may include an editing process and an expanding process. Further, the image process section 61 may store the generated image data DT2 in the storage device 53. The image process section 61 may also submit a job to a print queue. A detailed description is given below of operation of the image process section 61 after the communicator 51 has received the print data DP.

First, the image process section 61 may initialize a page count PC, a top page count TPC, a cutting count CC, and an accumulated use amount TU (step S101). The page count PC may be a variable that is incremented each time the image process is performed on the basis of the image data DT corresponding to a single page. The image data DT corresponding to a single page may be included in the print data DP. The top page count TPC may be a variable that indicates the page number of a top page in a section page group SEG, in a case where the print data DP includes the cutting command CMD. The section page group SEG may be a page group including a plurality of pages sectioned in accordance with the cutting instruction INS. The cutting count CC may be a variable that is incremented on the basis of the cutting instruction INS in the case where the print data DP includes the cutting command CMD. The foregoing cutting instruction INS may be generated for every plurality of pages, for example. The accumulated use amount TU may be a variable that indicates a use amount of the toner estimated on the basis of the generated image data DT2. The image process section 61 may set each of the page count PC, the top page count TPC, the cutting count CC, and the accumulated use amount TU to "0 (zero)" ("PC=0, TPC=0, CC=0, TU=0").

Thereafter, the image process section 61 may confirm whether the print data DP includes the cutting command CMD (step S102). A case where the print data DP includes the cutting command CMD may correspond to the cases C1 and C2. A case where the print data DP does not include the cutting command CMD may correspond to the case C3. When the print data DP includes the cutting command CMD ("Y" in step S102), the flow may proceed to step S103. When the print data DP does not include the cutting command CMD ("N" in step S102), the flow may proceed to step S118 illustrated in FIG. 3C.

When the print data DP includes the cutting command CMD in step S102 ("Y" in step S102), the image process section 61 may thereafter confirm whether the image data DT included in the print data DP includes an unprocessed image data DT (step S103).

When the image data DT included in the print data DP includes the unprocessed image data DT in step S103 ("Y" in step S103), the image process section 61 may perform the image process on the basis of the image data DT, corresponding to a single page, of the unprocessed image data DT (step S104). The image process may include the editing process and the expanding process. Further, the image process section 61 may store, in the storage device 53, the image data DT2 generated by performing the image process. Further, the image process section 61 may estimate a use amount TU1 on the basis of a result of the foregoing image process (step S105). The use amount TU1 may be an amount of the toner, in the toner container 33 of interest, to be used when image formation is performed on the basis of the image data DT2 corresponding to the single page.

Thereafter, the image process section 61 may increment the page count PC (PC=PC+1) and update the accumulated use amount TU by adding the use amount TU1 to the accumulated use amount TU (TU=TU+TU1) (step S106).

Thereafter, the image process section 61 may confirm whether the cutting instruction INS is generated (step S107). For example, in a case where the cutting command CMD instructs to perform the cutting once for every three pages, the image process section 61 may generate a single cutting instruction INS each time the image data DT corresponding to three pages is subjected to a process. The image process section 61 may confirm whether the cutting instruction INS described above is generated. When the cutting instruction INS is not generated ("N" in step S107), the flow may return to step S103, and steps S103 to S107 may be repeatedly performed until the cutting instruction INS is generated.

When the cutting instruction INS is generated in step S107 ("Y" in step S107), the image process section 61 may increment the cutting count CC (CC=CC+1) (step S108).

Thereafter, the image process section 61 may generate page information INFP of a TPC-th page (step S109). The TPC-th page may be a page indicated by the top page count TPC. The page information INFP may include two variables, i.e., a variable INFPA and a variable INFPB. The image process section 61 may set the variable INFPA to a value indicated by the accumulated use amount TU (INFPA=TU), and set the variable INFPB to a value corresponding to a difference between the page count PC and the top page count TPC (INFPB=PC−TPC). The difference between the page count PC and the top page count TPC may be a page number PN of the section page group SEG The section page group SEG may be a page group including a plurality of pages sectioned in accordance with the cutting instruction INS. Further, the image process section 61 may store the generated page information INFP in the memory 63.

For example, on a condition that the cutting command CMD instructs to perform cutting once for every three pages and the cutting instruction INS is generated for the first time in step S106, the page count PC is "3" and the top page count TPC is "0 (zero)". Accordingly, "3" is set to the variable INFPB. In other words, "3" set to the variable INFPB may correspond to the page number PN of the section page group SEG generated before the cutting instruction INS. Thus, the page information INFP of the "0 (zero)"-th page, i.e., the top page of this section page group SEG may be generated.

Thereafter, the image process section 61 may confirm whether the notification mode MD is set to be "enabled" (step S110). A case where the notification mode MD is set to be "enabled" may correspond to the case C1. A case where the notification mode MD is set to be "disabled" may correspond to the case C2. When the notification mode MD is set to be "disabled" ("N" in step S110), the flow may proceed to step S112.

When the notification mode MD is set to be "enabled" in step S110 ("Y" in step S110), the image process section 61 may submit, to the print queue, the page information INFP generated in step S109 and an index of the image data DT2 generated in step S104 (step S111).

Thereafter, the image process section 61 may set the top page count TPC to a value indicated by the page count PC (TPC=PC) (step S112). For example, on a condition that the cutting command CMD indicates to perform cutting once for every three pages and the cutting instruction INS is generated for the first time in step S106, the page count PC is "3". Therefore, the top page count TPC is set to "3". Thus, the top page count TPC is changed from "0 (zero)" to "3". Thereafter, the flow may return to step S103.

The image process section 61 may repeatedly perform the processes in steps S103 to S112 until all of the image data DT included in the print data DP is processed. When all of the image data DT included in the print data DP is processed ("N" in step S103), the image process section 61 may confirm whether the notification mode MD is set to be "enabled" (step S113 illustrated in FIG. 3B). A case where the notification mode MD is set to be "enabled" may correspond to the case C1. A case where the notification mode MD is set to be "disabled" may correspond to the case C2.

When the notification mode MD is set to be "enabled" in step S113 ("Y" in step S113), the image process section 61 may generate job information INFJ (step S114). The job information INFJ may include three variables, i.e., a variable INFJ1, a variable INFJ2, and a variable INFJ3. The image process section 61 may set the variable INFJ1 to the value indicated by the page count PC (INFJ1=PC), set the variable INFJ2 to a value indicated by the cutting count CC (INFJ2=CC), and set the variable INFJ3 to "0 (zero)" (INFJ3=0). Further, the image process section 61 may store the generated job information INFJ in the memory 63.

Thereafter, the image process section 61 may submit, to the print queue, the job information INFJ generated in step S114 (step S115).

When the notification mode MD is set to be "disabled" in step S113 ("N" in step S113), the image process section 61 may generate the job information INFJ (step S116). The image process section 61 may set the variable INFJ1 to the value indicated by the page count PC (INFJ1=PC), set the variable INFJ2 to the value indicated by the cutting count CC (INFJ2=CC), and set the variable INFJ3 to a value indicated by the accumulated use amount TU (INFJ3=TU). Further, the image process section 61 may store the generated job information INFJ in the memory 63.

Thereafter, the image process section 61 may submit, to the print queue, the job information INFJ generated in step S116 and the index of the image data DT2 generated in step S104 (step S117).

When the print data DP does not include the cutting command CMD in step S102 ("N" in step S102), the image process section 61 may confirm whether the image data DT included in the print data DP includes unprocessed image data DT (step S118 illustrated in FIG. 3C).

When the image data DT included in the print data DP includes the unprocessed image data DT in step S118 ("Y" in step S118), the image process section 61 may perform the image process on the basis of the image data DT, corresponding to a single page, of the unprocessed image data DT (step S119). The image process may include the editing process and the expanding process. Further, the image process section 61 may store, in the storage device 53, the image data DT2 generated by performing the image process. Further, the image process section 61 may estimate the use amount TU1 on the basis of a result of the foregoing image process (step S120). The use amount TU1 may be an amount of the toner, in the toner container 33 of interest, to be used when image formation is performed on the basis of the image data DT2 corresponding to the single page.

Thereafter, the image process section 61 may increment the page count PC (PC=PC+1) and update the accumulated use amount TU with the use of the use amount TU1 (TU=TU+TU1) (step S121). Thereafter, the flow may return to step S118.

The image process section 61 may repeatedly perform the processes in steps S118 to S121 until all of the image data DT included in the print data DP is processed. When all of the image data DT included in the print data DP is processed ("N" in step S118), the image process section 61 may generate the job information INFJ (step S122). The image process section 61 may set the variable INFJ1 to the value indicated by the page count PC (INFJ1=PC), set the variable INFJ2 to "0 (zero)" (INFJ2=0), and set the variable INFJ3 to the value indicated by the accumulated use amount TU (INFJ3=TU).

Thereafter, the image process section 61 may submit, to the print queue, the job information INFJ generated in step S122 and the index of the image data DT2 generated in step S119 (step S123).

This may be the end of this flow. In the above-described manner, the image process section 61 may generate the image data DT2 by performing the image process on the basis of the print data DP, and submit a job to the print queue.

FIG. 4 illustrates an example of the page information INFP and the job information INFJ in the three cases C1 to C3.

As described above, in the case C1, the print data DP may include the cutting command CMD, and the notification mode MD may be set to be "enabled". The page information INFP may be generated in step S109 illustrated in FIG. 3A in the case C1. The variable INFPA of the page information INFP may be set to the accumulated use amount TU2. The accumulated use amount TU2 may indicate a use amount of the toner accumulated up to the page related to the page information INFP. The variable INFPB of the page information INFP may be set to the page number PN. The page number PN may indicate the number of pages in the section page group SEG including the page related to the page information INFP.

In the case C1, the job information INFJ may be generated in step S114 illustrated in FIG. 3B. The variable INFJ1 of the job information INFJ may be set to a total page count PCA. The total page count PCA may indicate the number of pages in total in the job. The variable INFJ2 of the job information INFJ may be set to a total cutting count CCA. The total cutting count CCA may indicate the number of cutting to be performed in total in the job. The variable INFJ3 of the job information INFJ may be set to "0 (zero)".

As described above, in the case C2, the print data DP may include the cutting command CMD, and the notification mode MD may be set to be "disabled". The page information INFP may be generated in step S109 illustrated in FIG. 3A in the case C2. The page information INFP in the case C2 may be similar to that in the case C1.

In the case C2, the job information INFJ may be generated in step S116 illustrated in FIG. 3B. The variable INFJ1 of the job information INFJ may be set to the total page count PCA. The variable INFJ2 of the job information INFJ may be set to the total cutting count CCA. The variable INFJ3 of the job information INFJ may be set to the total use amount TUA. The total use amount TUA may indicate an amount of the toner to be used in total in the job.

As described above, in the case C3, the print data DP may not include the cutting command CMD. The cutting may not be performed on the print medium 9 in the case C3. Therefore, the page information INFP may not be generated. In contrast, the job information INFJ may be generated in step S122 illustrated in FIG. 3C. The variable INFJ1 of the job information INFJ may be set to the total page count PCA. The variable INFJ2 of the job information INFJ may be set to "0 (zero)". The variable INFJ3 of the job information INFJ may be set to the total use amount TUA.

In the case C1, the variable INFJ3 of the job information INFJ may be set to "0 (zero)". One reason for this may be the following. That is, the printing process section 62 may confirm whether the toner is sufficient each time the cutting is performed on the print medium 9 in the case C1. For example, the printing process section 62 may confirm whether the toner is sufficient with the use of the variable INFPA (the accumulated use amount TU2) of the page information INFP, as will be described below. Therefore, it may not be necessary to set the variable INFJ3 to the total use amount TUA as in the cases C2 and C3. Hence, the variable INFJ3 may be set to "0 (zero)".

In the case C3, the variable INFJ2 of the job information INFJ may be set to "0 (zero)". The image forming apparatus 1 may not perform the cutting on the print medium 9 in the case C3. Therefore, the variable INFJ2 may not be set to the total cutting count CCA as in the cases C1 and C2, and may be set to "0 (zero)".

As described above, the variable INFJ3 of the job information INFJ may be set to "0 (zero)" in the case C1, and the variable INFJ2 of the job information INFJ may be set to "0 (zero)" in the case C3. Thereby, the printing process section 62 may perform determination in the respective cases C1 to C3 by utilizing the variables INFJ2 and INFJ3, as will be described below.

[Operation of Printing Process Section 62]

Figure 5A:
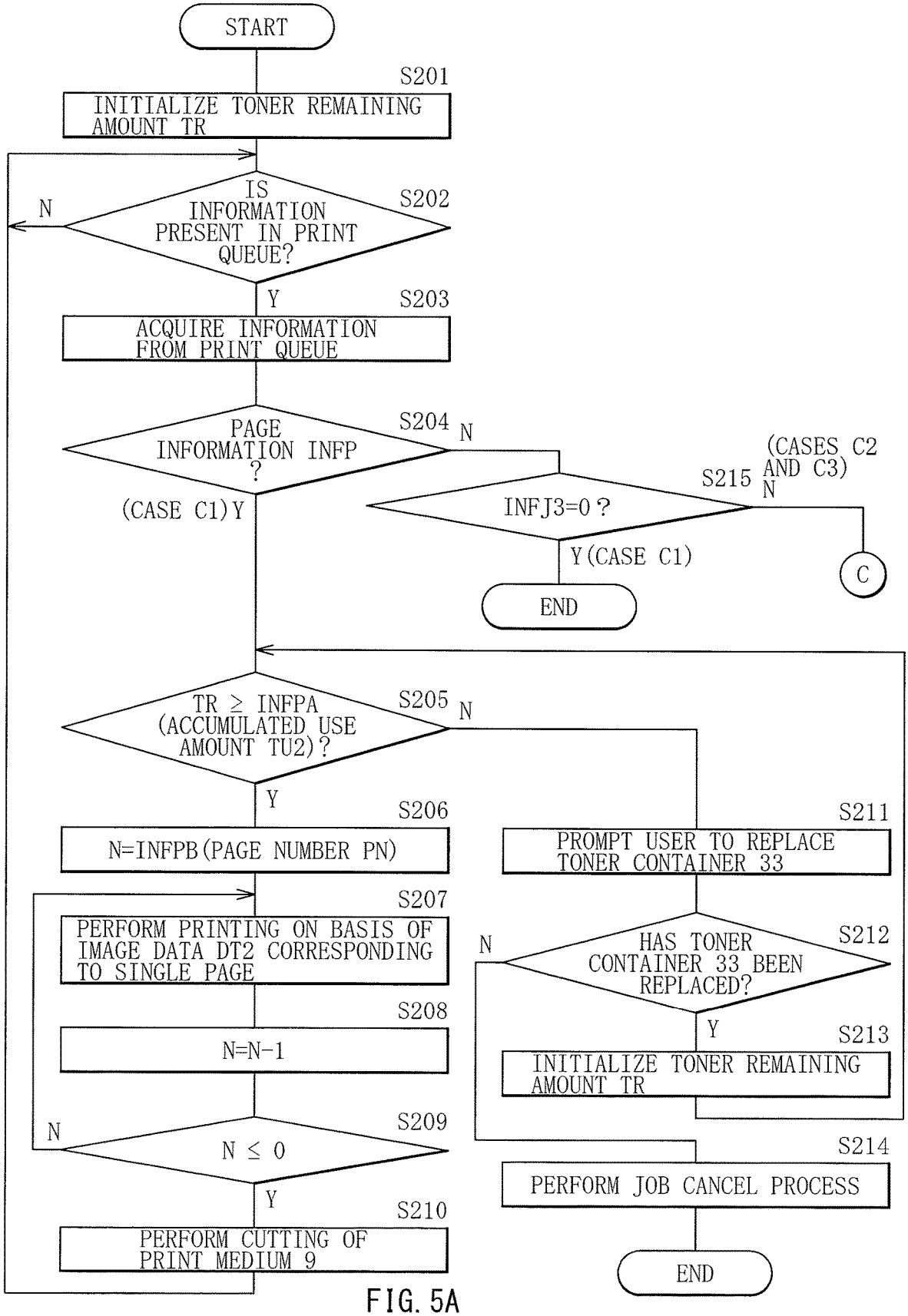
FIG. 5A is a flowchart illustrating an example of operation of a printing process section illustrated in FIG. 2.
Figure 5B:
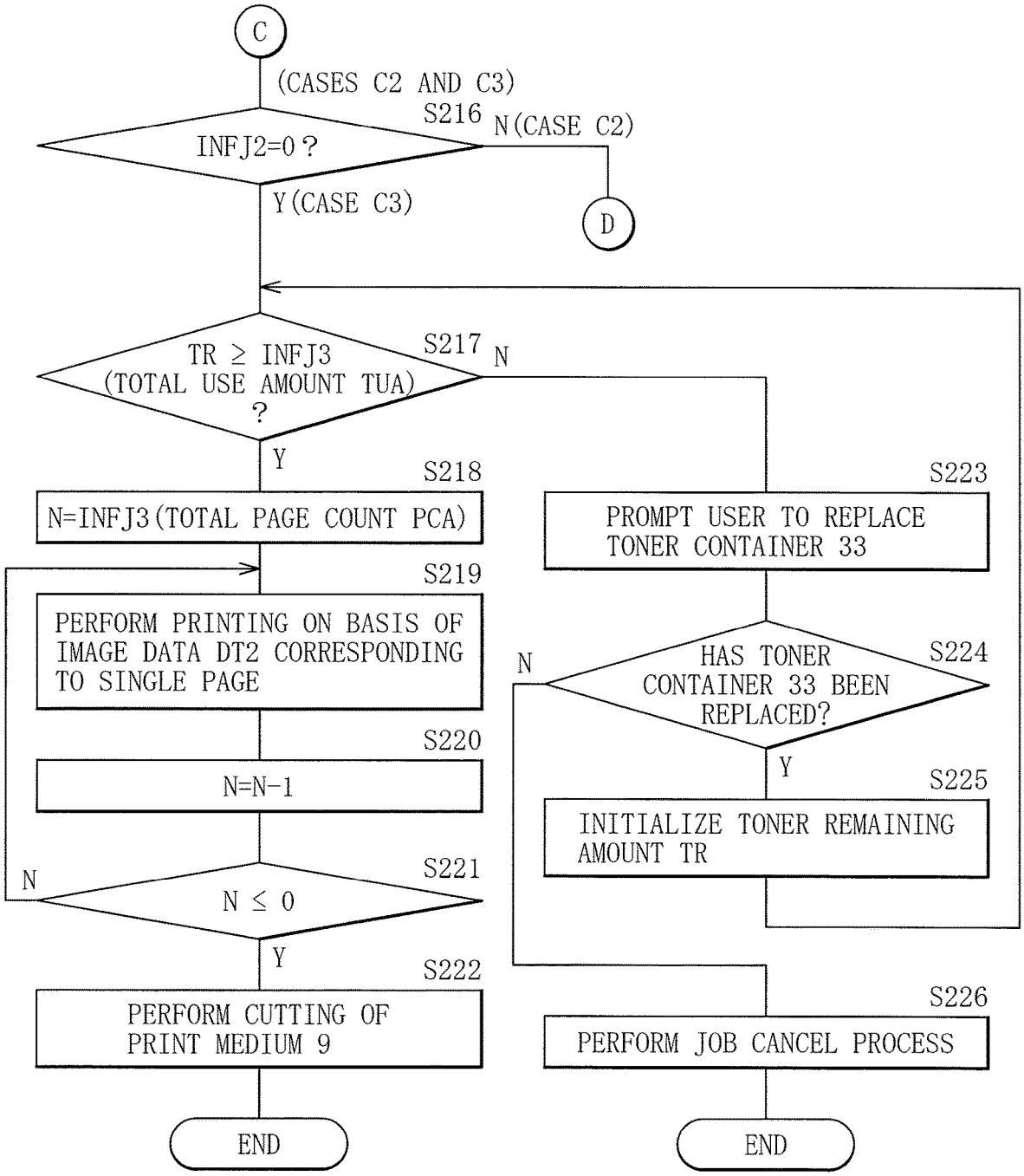
FIG. 5B is another flowchart illustrating an example of the operation of the printing process section illustrated in FIG. 2.
Figure 5C:
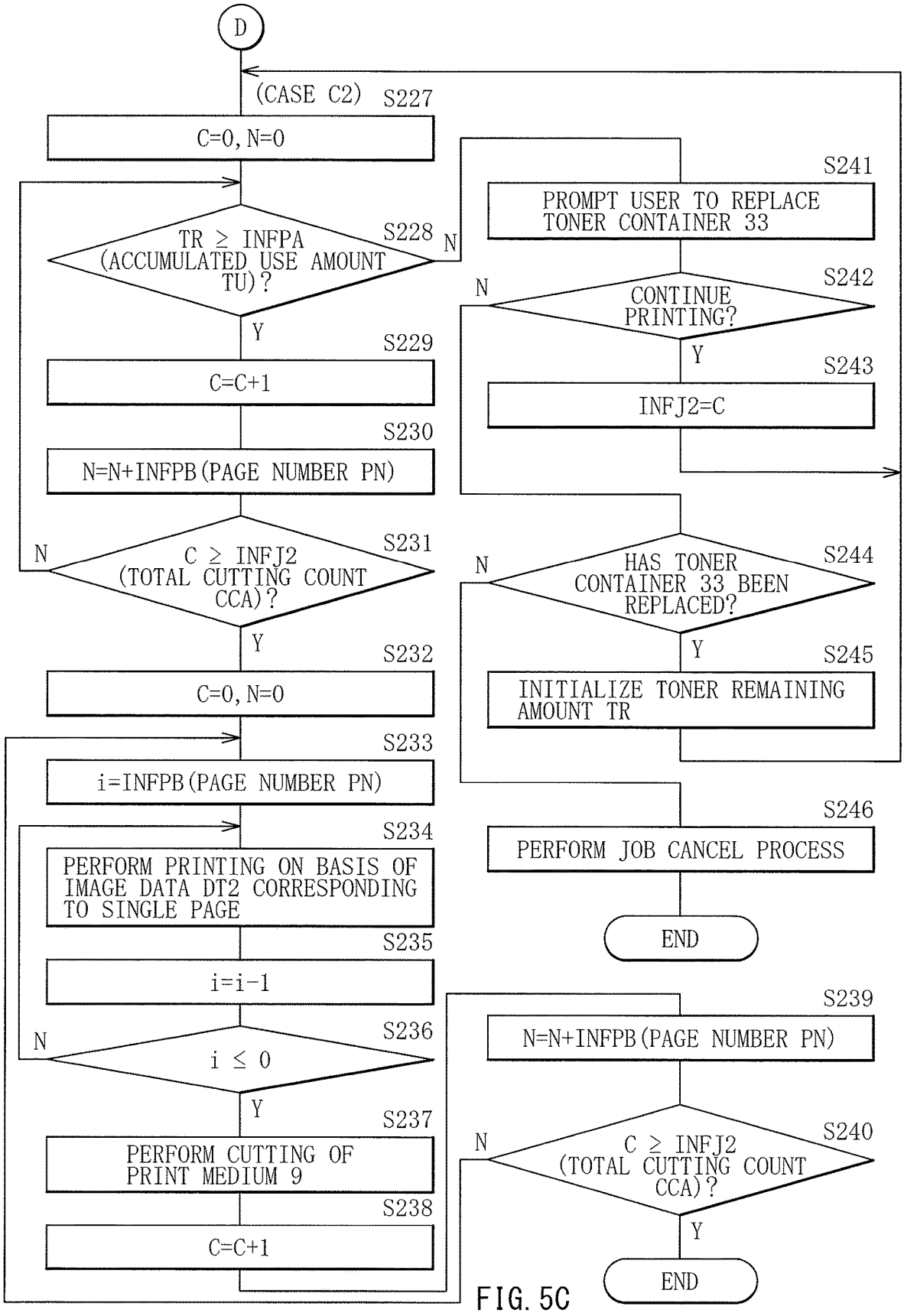
FIG. 5C is still another flowchart illustrating an example of the operation of the printing process section illustrated in FIG. 2.

FIGS. 5A to 5C illustrate an example of operation of the printing process section 62. The printing process section 62 may perform the printing process on the basis of the information submitted to the print queue and the image data DT2 generated by the image process section 61 and stored in the storage device 53. A detailed description is given below of this operation.

First, the printing process section 62 may initialize the toner remaining amount TR (step S201). The toner remaining amount TR may be a variable that indicates a remaining amount of the toner in the toner container 33 of interest. For example, the information reader 55 may read the information from the IC tag 34 of the toner container 33 of interest. Thereby, the printing process section 62 may acquire a value of the remaining amount of the toner in the toner container 33 of interest, and set the toner remaining amount TR to the acquired value. Thus, the printing process section 62 may initialize the toner remaining amount TR.

It is to be noted that the way of initializing the toner remaining amount TR is not limited to the manner described above. For example, the controller 60 may hold information related to the remaining amount of the toner in the toner container 33 of interest, and the printing process section 62 may initialize the toner remaining amount TR on the basis of the information related to the remaining amount of the toner held by the controller 60. In this case, for example, the information in the IC tag 34 and the information held by the controller 60 may be synchronized with each other. Such synchronization between the information in the IC tag 34 and the information held by the controller 60 may be achieved by the controller 60 periodically reading the information from the IC tag 34 of each of the toner containers 33 and the controller 60 periodically writing the information on the IC tag 34. In this case, the information, related to the remaining amount of the toner, stored in the IC tag 34 and the information, related to the remaining amount of the toner, held by the controller 60 may be substantially coincident with each other. Therefore, the printing process section 62 may initialize the toner remaining amount TR on the basis of the information related to the remaining amount of the toner held by the controller 60.

Thereafter, the printing process section 62 may confirm whether information is present in the print queue (step S202). When no information is present in the print queue ("N" in step S202), the printing process section 62 may repeatedly perform the process in step S202. When the information is present in the print queue ("Y" in step S202), the printing process section 62 may acquire the information from the print queue (step S203).

Thereafter, the printing process section 62 may confirm which of the page information INFP and the job information INFJ the information acquired from the print queue is (step S204). A case where the information acquired from the print queue is the page information INFP ("Y" in step S204) may correspond to the case C1 on the basis of one reason as follows. That is, the page information INFP may be generated (step S109 illustrated in FIG. 3A) in both of the case C1 and the case C2; however, the page information INFP may be submitted to the print queue only in the case C1 (step S111 illustrated in FIG. 3A).

When the information acquired from the print queue is the page information INFP in step S204 ("Y" in step S204), the printing process section 62 may confirm whether the toner remaining amount TR is equal to or greater than the value indicated by the variable INFPA of the page information INFP, i.e., the accumulated use amount TU2 (step S205).

When the toner remaining amount TR is equal to or greater than the value indicated by the variable INFPA of the page information INFP, i.e., the accumulated use amount TU2 ("Y" in step S205), the toner necessary to perform printing of the section page group SEG corresponding to the page information INFP may remain in the toner container 33 of interest. Therefore, the printing process section 62 may set a variable N to the value indicated by the variable INFPB (the page number PN) of the page information INFP (N=INFPB) (step S206). Thereafter, the printing process section 62 may acquire the image data DT2 corresponding to a single page from the storage device 53 with the use of the index in the print queue, and the image forming section 20 may perform printing on the basis of the acquired image data DT2 on the basis of the instruction given from the printing process section 62 (step S207). Thereafter, the printing process section 62 may decrement the variable N (N=N−1) (step S208). Thereafter, the printing process section 62 may confirm whether the variable N is equal to or smaller than "0 (zero)" (N≤0) (step S209). When the variable N is not equal to or smaller than "0 (zero)" ("N" in step S209), the flow may return to step S207. Thereby, the printing process section 62 may repeatedly perform the processes in steps S207 to S209 until the variable N becomes equal to or smaller than "0 (zero)". The image forming apparatus 1 may thus perform the printing of the section page group SEG corresponding to the page information INFP acquired from the print queue.

FIG. 6 illustrates an example of a display image P201 to be displayed on the display operation section 52 while printing is being performed. In this example, the display image P201 may include information indicating that the "second page" out of "three pages" is being printed. In this example, the "three pages" may be the number of pages in the section page group SEG, for which the variable INFPB (the page number PN) of the page information INFP may be used. Further, the "second page" may indicate the page that is being currently printed, which may be obtained, for example, by calculating "1+(INFPB−N)" with the use of the variable INFPB (the page number PN) and the variable N.

Thereafter, the cutter 14 may perform cutting of the print medium 9 on the basis of an instruction given from the printing process section 62 (step S210). Thereafter, the flow may return to step S202.

When the toner remaining amount TR is not equal to or greater than the value indicated by the variable INFPA of the page information INFP, i.e., the accumulated use amount TU2 in step S205 ("N" in step S205), the toner necessary to perform printing of the section page group SEG corresponding to the page information INFP may not remain in the toner container 33 of interest. Therefore, the display operation section 52 may display, on the basis of an instruction given from the printing process section 62, a message prompting the user to replace the toner container 33 (step S211).

FIG. 7 illustrates an example of a display image P202 displaying a message to prompt the user to replace the toner container 33. In this example, the display image P202 may include information indicating that the "cyan" toner may possibly run out before completion of printing of the "three pages". The display image P202 may also include the message prompting the user to replace the toner container 33C. In this example, the "three pages" may be the number of pages in the section page group SEG, for which the variable INFPB (the page number PN) of the page information INFP may be used.

Thereafter, the printing process section 62 may confirm whether the user has performed any of replacing of the toner container 33 and operating of a cancel button (step S212). When the user has replaced the toner container 33 ("Y" in step S212), the printing process section 62 may initialize the toner remaining amount TR (step S213). In one example, the information reader 55 may read information from the IC tag 34 of the toner container 33 after the replacement. Thereby, the printing process section 62 may acquire a value of the remaining amount of the toner in the toner container 33, and set the toner remaining amount TR to the acquired value. Thereafter, the flow may return to step S205.

When the user has operated the cancel button in step S212 ("N" in step S212), the printing process section 62 may perform a job cancel process (step S214). Thereafter, the flow may be brought to an end.

When the information acquired from the print queue is the job information INFJ in step S204 ("N" in step S204), the printing process section 62 may confirm whether the variable INFJ3 of the job information INFJ is "0 (zero)" (INFJ3=0) (step S215). A case where the variable INFJ3 of the job information INFJ is "0 (zero)" may correspond to the case C1. A case where the variable INFJ3 of the job information INFJ is not "0 (zero)" may correspond to the cases C2 and C3. When the variable INFJ3 of the job information INFJ is "0 (zero)" ("Y" in step S215), the flow may be brought to an end. This may complete the printing in the case C1.

When the variable INFJ3 of the job information INFJ is not "0 (zero)" in step S215 ("N" in step S215), the printing process section 62 may confirm whether the variable INFJ2 of the job information INFJ is "0 (zero)" (INFJ2=0) (step S216 in FIG. 5B). A case where the variable INFJ2 of the job information INFJ is "0 (zero)" may correspond to the case C3. A case where the variable INFJ2 of the job information INFJ is not "0 (zero)" may correspond to the case C2.

When the variable INFJ2 of the job information INFJ is "0 (zero)" in step S216 ("Y" in step S216), the printing process section 62 may confirm whether the toner remaining amount TR is equal to or greater than a value indicated by the variable INFJ3 of the job information INFJ, i.e., the total use amount TUA (step S217).

When the toner remaining amount TR is equal to or greater than the value indicated by the variable INFJ3 of the job information INFJ, i.e., the total use amount TUA, in step S217 ("Y" in step S217), the toner necessary to perform printing of all of the pages related to the print job may remain in the toner container 33 of interest. Therefore, the printing process section 62 may set the variable N to the value indicated by the variable INFJ1 of the job information INFJ, i.e., the total page count PCA (N=INFJ1) (step S218). Thereafter, the printing process section 62 may acquire the image data DT2 corresponding to a single page from the storage device 53 with the use of the index in the print queue, and the image forming section 20 may perform printing on the basis of the acquired image data DT2, on the basis of the instruction given from the printing process section 62 (step S219). Thereafter, the printing process section 62 may decrement the variable N (N=N−1) (step S220). Thereafter, the printing process section 62 may confirm whether the variable N is equal to or smaller than "0 (zero)" (N≤0) (step S221). When the variable N is not equal to or smaller than "0 (zero)" ("N" in step S221), the flow may return to step S219. Thereby, the printing process section 62 may repeatedly perform the processes in steps S219 to S221 until the variable N becomes equal to or smaller than "0 (zero)". The image forming apparatus 1 may thus perform printing of all of the pages related to the job information INFJ acquired from the print queue.

FIG. 8 illustrates an example of a display image P203 to be displayed on the display operation section 52 while printing is being performed. In this example, the display image P203 may include information indicating that the "twenty-first page" out of "ninety pages" is being printed. In this example, the "ninety pages" may be the number of total pages in this print job, for which the variable INFJ1 of the job information INFJ, i.e., the total page count PCA, may be used. Further, the "twenty-first page" may indicate the page that is being currently printed, which may be obtained, for example, by calculating "1+(INFJ1−N)" with the use of the variable INFJ1 (the total page count PCA) and the variable N.

Thereafter, the cutter 14 may perform cutting of the print medium 9 on the basis of an instruction given from the printing process section 62 (step S222). This may complete the printing in the case C3.

When the toner remaining amount TR is not equal to or greater than the value indicated by the variable INFJ3 of the job information INFJ, i.e., the total use amount TUA, in step S217 ("N" in step S217), the toner necessary to perform printing of all of the pages related to the print job may not remain in the toner container 33 of interest. Therefore, the display operation section 52 may display, on the basis of an instruction given from the printing process section 62, a message prompting the user to replace the toner container 33 (step S223).

FIG. 9 illustrates an example of a display image P204 displaying a message to prompt the user to replace the toner container 33. In this example, the display image P204 may include information indicating that the "cyan" toner may possibly run out before completion of printing of the "ninety pages". The display image P204 may also include the message prompting the user to replace the toner container 33C. In this example, the "ninety pages" may be the number of total pages in this print job, for which the variable INFJ1 of the job information INFJ, i.e., the total page count PCA, may be used.

Thereafter, the printing process section 62 may confirm whether the user has performed any of replacing of the toner container 33 and operating of the cancel button (step S224). When the user has replaced the toner container 33 ("Y" in step S224), the printing process section 62 may initialize the toner remaining amount TR (step S225). Thereafter, the flow may return to step S217.

When the user has operated the cancel button in step S224 ("N" in step S224), the printing process section 62 may perform a job cancel process (step S226). Thereafter, the flow may be brought to an end.

When the variable INFJ2 of the job information INFJ is not "0 (zero)" in step S216 ("N" in step S216), the printing process section 62 may set a variable C to "0 (zero)", and set the variable N to "0 (zero)" (C=0, N=0) (step S227).

Thereafter, the printing process section 62 may acquire the page information INFP of the "N-th" page from the memory 63, and confirm whether the toner remaining amount TR is equal to or greater than the value indicated by the variable INFPA of the acquired page information INFP, i.e., the accumulated use amount TU (step S228).

When the toner remaining amount TR is equal to or greater than the value indicated by the variable INFPA of the page information INFP, i.e., the accumulated use amount TU in step S228 ("Y" in step S228), the toner necessary to perform printing of the section page group SEG corresponding to the page information INFP may remain in the toner container 33 of interest. Therefore, the printing process section 62 may increment the variable C (C=C+1) (step S229). Further, the printing process section 62 may add, to the variable N, the value indicated by the variable INFPB of the page information INFP, i.e., the page number PN, and thereby update the variable N (N=N+INFPB) (step S230). Thereafter, the printing process section 62 may confirm whether the variable C is equal to or greater than the value indicated by the variable INFJ2 of the job information INFJ, i.e., the total cutting count CCA (C≥INFJ2) (step S231). When the variable C is not equal to or greater than the value indicated by the variable INFJ2, i.e., the total cutting count CCA ("N" in step S231), the flow may return to step S228. Thereby, the printing process section 62 may repeatedly perform the processes in steps S228 to S231 until the variable C becomes equal to or greater than the value indicated by the total cutting count CCA. The printing process section 62 may thereby sequentially acquire the page information INFP from the memory 63, and confirm whether the toner remaining amount TR is equal to or greater than the value indicated by the accumulated use amount TU. Thus, the image forming apparatus 1 may confirm whether the toner is sufficient before starting the image formation on the print medium 9, and calculate the cuttable time number when the toner is not sufficient. The cuttable time number may be the number of times that the print medium 9 is cuttable before the toner becomes insufficient.

When the variable C is equal to or greater than the value indicated by the total cutting count CCA in step S231 ("Y" in step S231), the toner necessary to perform printing of all of the pages related to the print job may remain in the toner container 33 of interest. Therefore, the image forming apparatus 1 may start image formation on the print medium 9. First, the printing process section 62 may set the variable C to "0 (zero)", and set the variable N to "0 (zero)" (C=0, N=0) (step S232).

Thereafter, the printing process section 62 may acquire the page information INFP of the "N-th" page from the memory 63, and set a variable "i" to a value indicated by the variable INFPB of the acquired page information INFP, i.e., the page number PN (N=INFPB) (step S233). Thereafter, the printing process section 62 may acquire the image data DT2 corresponding to a single page from the storage device 53 with the use of the index in the print queue, and the image forming section 20 may perform printing on the basis of the acquired image data DT2, on the basis of the instruction given from the printing process section 62 (step S234). Thereafter, the printing process section 62 may decrement the variable "i" (i=i−1) (step S235). Thereafter, the printing process section 62 may confirm whether the variable "i" is equal to or smaller than "0 (zero)" (i≤0) (step S236). When the variable "i" is not equal to or smaller than "0 (zero)" ("N" in step S236), the flow may return to step S234. Thereby, the printing process section 62 may repeatedly perform the processes in steps S234 to S236 until the variable "i" becomes equal to or smaller than "0 (zero)". The image forming apparatus 1 may thus perform the printing of the section page group SEG corresponding to the page information INFP acquired from the memory 63. Thereafter, the cutter 14 may perform cutting of the print medium 9 on the basis of an instruction given from the printing process section 62 (step S237).

Thereafter, the printing process section 62 may increment the variable C (C=C+1) (step S238). Thereafter, the printing process section 62 may add, to the variable N, the value indicated by the variable INFPB of the page information INFP, i.e., the page number PN, and thereby update the variable N (N=N+INFPB) (step S239).

Thereafter, the printing process section 62 may confirm whether the variable C is equal to or greater than the value indicated by the variable INFJ2 of the job information INFJ, i.e., the total cutting count CCA (C≥INFJ2) (step S240). When the variable C is not equal to or greater than the value indicated by the variable INFJ2 of the job information INFJ, i.e., the total cutting count CCA ("N" in step S240), the flow may return to step S233. Thereby, the printing process section 62 may repeatedly perform the processes in steps S233 to S240 until the variable C becomes equal to or greater than the value indicated by the total cutting count CCA.

FIG. 10 illustrates an example of a display image P205 to be displayed on the display operation section 52 while printing is being performed. In this example, the display image P205 may include information indicating that the cutting of the "sixth time" out of "twenty-nine times" has been performed. The display image P205 may also include information indicating that the "second page" out of "three pages" is being printed. In this example, the "twenty-nine times" may be the total cutting number in this print job, for which the variable INFJ2 of the job information INFJ, i.e., the total cutting count CCA, may be used. The "sixth time" may be the number of cutting that has been performed until present, for which the variable C may be used. The "three pages" may be the number of pages in the section page group SEG, for which the variable INFPB of the page information INFP, i.e., the page number PN, may be used. Further, the "second page" may indicate the page that is being currently printed, which may be obtained, for example, by calculating "1+(INFPB−i)" with the use of the variable INFPB (the page number PN) and the variable "i".

This may complete the printing in the case C2.

When the toner remaining amount TR is not equal to or greater than the value indicated by the variable INFPA of the page information INFP, i.e., the accumulated use amount TU in step S228 ("N" in step S228), the toner necessary to perform printing of the section page group SEG corresponding to the page information INFP may not remain in the toner container 33 of interest. Therefore, the display operation section 52 may display, on the basis of an instruction given from the printing process section 62, a message prompting the user to replace the toner container 33 (step S241). On this occasion, for example, the printing process section 62 may calculate the cuttable time number which is the number of times the cutting is able to be performed until the toner runs out. Further, the display operation section 52 may display the calculated cuttable time number.

FIG. 11 illustrates an example of a display image P206 displaying a message to prompt the user to replace the toner container 33. In this example, the display image P206 may include information indicating that the "cyan" toner may possibly run out before the cutting of the "sixth time" out of the "twenty-nine times" is performed. The display image P206 may also include the message prompting the user to replace the toner container 33C. In this example, the user may be also allowed to select to continue the printing until the toner runs out. In this example, the "twenty-nine times" may be the number of total times of cutting to be performed in this print job, for which the variable INFJ2 of the job information INFJ, i.e., the total cutting count CCA, may be used. The "sixth time" may be the number of times of cutting to be performed before the toner runs out, for which the variable C may be used.

Thereafter, the printing process section 62 may confirm whether the user has operated an OK button (step S242). When the user has operated the OK button ("Y" in step S242), the printing process section 62 may set the variable INFJ2 of the job information INFJ to the value indicated by the variable C (INFJ2=C) (step S243). In other words, the variable C at this timing may indicate the number of times of cutting to be performed before the toner runs out. Therefore, the value of the variable INFJ2 may be set to the number of times of cutting to be performed before the toner runs out. Thereafter, the flow may return to step S227.

When the user has not operated the OK button in step S242 ("N" in step S242), the printing process section 62 may confirm whether the user has performed any of replacing of the toner container 33 and operating of the cancel button (step S244). When the user has replaced the toner container 33 ("Y" in step S244), the printing process section 62 may initialize the toner remaining amount TR (step S245). Thereafter, the flow may return to step S227.

When the user has operated the cancel button in step S244 ("N" in step S244), the printing process section 62 may perform a job cancel process (step S246). Thereafter, the flow may be brought to an end.

Thereby, for example, in the case C1, the image forming apparatus 1 may determine whether the toner is sufficient each time the cutter 14 performs cutting of the print medium 9, as described in steps S202 to S210 in FIG. 5A. When the toner is not sufficient, the image forming apparatus 1 may prompt the user to replace the toner container 33, as described in step S211 in FIG. 5A.

For example, in the case C2, the image forming apparatus 1 may determine, before starting image formation on the print medium 9, whether the toner is sufficient on the basis of the section page group SEG as a unit, as described in steps S228 to S231 in FIG. 5C. The section page group SEG may be a page group sectioned in accordance with the cutting instruction INS. When the toner is not sufficient, the image forming apparatus 1 may calculate the number of times that cutting is performable before the toner becomes insufficient as illustrated in FIG. 11. Further, the image forming apparatus 1 may prompt the user to replace the toner container 33, as described in step S241 in FIG. 5C.

For example, in the case C3, the image forming apparatus 1 may confirm, before starting image formation on the print medium 9, whether the toner is sufficient to perform the printing of all of the pages, as described in step S217 in FIG. 5B. When the toner is not sufficient, the image forming apparatus 1 may prompt the user to replace the toner container 33, as described in step S223 in FIG. 5B.

In the cases C1 and C2, the image forming apparatus 1 may calculate the estimated use amount of the toner on the basis of the section page group SEG, as a unit, sectioned in accordance with the cutting instruction INS. Further, the image forming apparatus 1 may determine whether the toner is sufficient on the basis of the calculated estimated use amount of the toner and the toner remaining amount TR. Thereby, for example, on a condition that the printing is to be performed for ninety pages by performing cutting once for every three pages and the toner remained in the toner container 33 is sufficient only for sixty-one pages, the image forming apparatus 1 is able to perform printing up to the sixtieth page. Accordingly, the toner is utilized effectively.

For example, in a case where whether the toner is sufficient to perform printing of all of the pages is confirmed before starting the image formation on the print medium 9, it may be determined that the toner is not sufficient as the toner sufficient for ninety pages does not remain in the toner container 33. Accordingly, the image forming operation may be prevented from being performed. In this case, the toner corresponding to sixty-one pages in the toner container 33 may be used uselessly. In contrast, the image forming apparatus 1 may determine whether the toner is sufficient on the basis of the section page group SEG as a unit. Therefore, in this example case, the printing is allowed to be performed up to the sixtieth page. Accordingly, the possibility of uselessly using the toner is reduced, and the toner is utilized effectively.

For example, in the case C1, the image forming apparatus 1 may determine whether the toner is sufficient each time the cutter 14 performs cutting of the print medium 9. This allows the image forming apparatus 1 to determine whether the toner is sufficient on the basis of the section page group SEG as a unit, also in a case where the image process is not to be performed on all of the pages before starting image formation on the print medium 9. The image process may include the editing process and the expanding process. As a result, the toner is utilized effectively in the image forming apparatus 1.

Moreover, for example, in the case C2, the image forming apparatus 1 may perform the image process on all of the pages before starting image formation on the print medium 9, and determine whether the toner is sufficient on the basis of the section page group SEG, as a unit, sectioned in accordance with the cutting instruction INS. The image process may include the editing process and the expanding process. Thereby, the image forming apparatus 1 is able to notify, before starting the image formation on the print medium 9, the user of whether the toner is sufficient. As a result, the toner is effectively utilized in the image forming apparatus 1.

Further, in the case C2, the image forming apparatus 1 may calculate the number of times that the cutting is performable before the toner becomes insufficient, in a case where the toner is not sufficient. Thereby, the image forming apparatus 1 allows the user to know in advance the number of pages that are printable without replacing the toner container 33. In a case where the number of pages that are printable without replacing the toner container 33 is enough for the user, the printing process can be continued without making any change. As a result, user-friendliness is improved in the image forming apparatus 1.

Example Effects

As described above, in one example embodiment of the technology, an estimated use amount of a toner may be calculated on the basis of a section page group, as a unit, sectioned in accordance with a cutting instruction. Further, whether the toner is sufficient may be determined on the basis of the estimated use amount and a toner remaining amount. Hence, it is possible to effectively utilize the toner.

In one example embodiment of the technology, whether the toner is sufficient may be determined each time a cutter performs cutting of a recording medium. Hence, it is possible to effectively utilize the toner.

In one example embodiment of the technology, whether the toner is sufficient may be determined, before image formation on the print medium is started, on the basis of the section page group, as a unit, sectioned in accordance with the cutting instruction. Hence, it is possible to effectively utilize the toner.

Modification Example 1

In the embodiment described above, any embodiment of the technology is applied to the toner container 33, however; this is non-limiting. Any embodiment of the technology is applicable to various consumable materials in the image forming apparatus 1.

For example, any embodiment of the technology may be applied to the image forming unit 31. In this case, for example, a use amount of the image forming unit 31 may be determined on the basis of the accumulated number of rotations of the photosensitive member 32, which is a so-called drum count. In another example, the use amount of the image forming unit 31 may be determined on the basis of the accumulated number of dots of the photosensitive member 32 subjected to exposure by the exposure unit, which is a so-called dot count.

Moreover, in one example, any embodiment of the technology may be applied to the belt section 40. In another example, one embodiment of the technology may be applied to the secondary transfer roller 25. In another example, one embodiment of the technology may be applied to the fixing section 27. In these cases, a use amount of each of the belt section 40, the secondary transfer roller 25, and the fixing section 27 may be determined on the basis of a distance by which the print medium 9 has been conveyed.

Moreover, in one example, any embodiment of the technology may be applied to the print medium 9. In this case, for example, a sensor may be provided that detects a remaining amount of the print medium 9 set in the print medium holder 11. This sensor may be able to detect the remaining amount of the print medium 9 set in the print medium holder 11 by detecting a factor such as an outer diameter of the roll of the print medium 9 or a rotation speed of a shaft of the roll.

Modification Example 2

In the embodiment described above, the controller 60 may perform the process on the basis of the information related to the setting of the notification mode MD stored as the apparatus setting, however; this is non-limiting. In an alternative example, the personal computer 100 may supply the image forming apparatus 1 with the information related to the setting of the notification mode MD, and the controller 60 may perform the process on the basis of the supplied information related to the setting of the notification mode MD.

The storage device 53 may have a large storage capacity, for example, and may include a component such as a non-volatile semiconductor memory or a hard disk drive, for example. Non-limiting examples of information to be held by the storage device 53 may include the image data DT2 on which the editing process and the expanding process have been performed by the controller 60, and the information related to the setting of the image forming apparatus 1, i.e., the apparatus setting. The apparatus setting may include a setting of the notification mode MD, i.e., a setting that instructs timing to notify the user of the information related to the consumable material in a case where the print data DP includes the cutting command CMD. In the case described above, the consumable material may be the toner container 33. For example, in a case where the notification mode MD is "enabled", the image forming apparatus 1 may confirm whether the toner is sufficient each time the cutter 14 perform cutting of the print medium 9, and display a result of the confirmation on the display operation section 52. In a case where the notification mode MD is "disabled", the image forming apparatus 1 may confirm whether the toner is sufficient before starting the image formation on the print medium 9, and display a result of the confirmation on the display operation section 52. The storage device 53 may hold information related to such a setting of the notification mode MD.

The technology has been described above referring to the example embodiments and the modification examples thereof. However, the technology is not limited to the example embodiments and the modification examples described above, and is modifiable in various ways.

For example, a color image may be formed on the print medium 9 in the example embodiments and the modification examples described above, however; this is non-limiting. In one example, a monochrome image may be formed.

For example, an image may be formed on the print medium 9 by an electrophotographic method in the example embodiments and the modification examples described above, however; this is non-limiting. In one example, an image may be formed by any method. In one example, any embodiment of the technology is applicable to a laser printer. In another example, one embodiment of the technology is applicable to an ink-jet printer.

For example, a toner image formed by the image forming unit 31 may be once transferred onto the transfer belt 44, and the toner image transferred onto the transfer belt 44 may be further transferred onto the print medium 9 in the example embodiments and the modification examples described above, however; this is non-limiting. In an alternative example, a toner image formed by an image forming unit may be directly transferred onto the print medium 9.

For example, one embodiment of the technology is applicable to various image forming apparatuses that are able to perform printing on a long print medium and perform a process on the page-unit basis. One embodiment of the technology is applicable to such an image forming apparatus that cannot be easily stopped immediately during printing.

Furthermore, the technology encompasses any possible combination of some or all of the various embodiments and the modifications described herein and incorporated herein.

It is possible to achieve at least the following configurations from the above-described example embodiments of the technology.

(1)

An image forming apparatus including:

a cutter that performs cutting of a print medium on the basis of a cutting instruction;

an image forming section that performs, on the basis of print data, image formation on the print medium with use of a consumable material; and a controller that calculates, on the basis of the print data, an estimated use amount on the basis of a section page group as a unit, and determines, on the basis of the estimated use amount and a usable amount, whether the image forming section is able to use the consumable material, the section page group being a page group, of the print medium, sectioned in accordance with the cutting instruction, the estimated use amount being an amount of the consumable material that is estimated to be used, the usable amount being a remaining amount of the consumable material that is usable.

(2)

The image forming apparatus according to (1), in which the controller determines whether the image forming section is able to use the consumable material through calculating, each time the cutter performs the cutting of the print medium, the estimated use amount of the consumable material that is estimated to be used until the cutter performs the subsequent cutting of the print medium.

(3)

The image forming apparatus according to (2), in which the controller determines, each time the cutter performs the cutting of the print medium, whether the image forming section is able to use the consumable material until the image forming section completes the image formation for the subsequent section page group.

(4)

The image forming apparatus according to (3), further including a notifying section that prompts a user to replace the consumable material when the controller determines that the image forming section is not able to use the consumable material.

(5)

The image forming apparatus according to any one of (2) to (4), in which the print data includes image data, the controller performs a predetermined image process on the basis of the image data, and the image forming section performs the image formation on the basis of image data on which the predetermined image process has been performed by the controller.

(6)

The image forming apparatus according to (1), in which the controller determines whether the image forming section is able to use the consumable material through calculating, before the image forming section starts the image formation, the estimated use amount on the basis of the section page group as the unit.

(7)

The image forming apparatus according to (6), in which the controller calculates a cuttable time number when the controller determines that the image forming section is to be not able to use the consumable material before the image forming section completes the image formation related to all pages included in the print data, the cuttable time number being number of times that the cutter is able to cut the print medium before the image forming section becomes not able to use the consumable material.

(8)

The image forming apparatus according to (7), further including a notifying section that notifies a user of the cuttable time number.

(9)

The image forming apparatus according to (6) or (7), in which the print data includes image data, the controller performs a predetermined image process on the basis of the image data before the image forming section starts the image formation, and the image forming section performs the image formation on the basis of image data on which the predetermined image process has been performed by the controller.

(10)

The image forming apparatus according to any one of (1) to (9), in which, when the print data includes control information related to the cutting of the print medium, the controller calculates, on the basis of the print data, the estimated use amount, and determines, on the basis of the estimated use amount and the usable amount, whether the image forming section is able to use the consumable material.

(11)

The image forming apparatus according to any one of (1) to (10), in which the image forming apparatus has a first operation mode and a second operation mode, the controller determines, in the first operation mode, whether the image forming section is able to use the consumable material through calculating, each time the cutter performs the cutting of the print medium, the estimated use amount of the consumable material that is to be used until the cutter performs the subsequent cutting of the print medium, and the controller determines, in the second operation mode, whether the image forming section is able to use the consumable material through calculating the estimated use amount on the basis of the section page group as the unit before the image forming section starts the image formation.

(12)

An image forming method including:

cutting, with a cutter, a print medium on the basis of a cutting position;

calculating, with a controller, on the basis of print data, an estimated use amount on the basis of a section page group as a unit, the estimated use amount being an amount of a consumable material that is estimated to be used, the section page group being a page group, of the print medium, sectioned in accordance with the cutting position;

determining, on the basis of the estimated use amount and a usable amount, whether an image forming section is able to use the consumable material, the usable amount being a remaining amount of the consumable material that is usable; and performing, with the image forming section, image formation on the print medium with use of the consumable material on the basis of the print data.

According to any of the image forming apparatus and the image forming method of one embodiment of the technology, the estimated use amount is calculated on the basis of the section page group as a unit. The estimated use amount is an amount of the consumable material to be used. Further, whether the consumable material is usable is determined on the basis of the estimated use amount and the usable amount. Hence, it is possible to effectively utilize the consumable material.

Although the technology has been described in terms of exemplary embodiments, it is not limited thereto. It should be appreciated that variations may be made in the described embodiments by persons skilled in the art without departing from the scope of the invention as defined by the following claims. The limitations in the claims are to be interpreted broadly based on the language employed in the claims and not limited to examples described in this specification or during the prosecution of the application, and the examples are to be construed as non-exclusive. For example, in this disclosure, the term "preferably", "preferred" or the like is non-exclusive and means "preferably", but not limited to. The use of the terms first, second, etc. do not denote any order or importance, but rather the terms first, second, etc. are used to distinguish one element from another. The term "substantially" and its variations are defined as being largely but not necessarily wholly what is specified as understood by one of ordinary skill in the art. The term "about" or "approximately" as used herein can allow for a degree of variability in a value or range. Moreover, no element or component in this disclosure is intended to be dedicated to the public regardless of whether the element or component is explicitly recited in the following claims.

What is claimed is:

1. An image forming apparatus comprising:

a cutter that performs cutting of a print medium on a basis of a cutting instruction;

an image forming section that performs, on a basis of print data, image formation on the print medium with use of a consumable material; and a controller that calculates, on the basis of the print data, an estimated use amount on a basis of a section page group as a unit, and determines, on a basis of the estimated use amount and a usable amount, whether the image forming section is able to use the consumable material, the section page group being a page group, of the print medium, sectioned in accordance with the cutting instruction, the estimated use amount being an amount of the consumable material that is estimated to be used, the usable amount being a remaining amount of the consumable material that is usable.

2. The image forming apparatus according to claim 1, wherein the controller determines whether the image forming section is able to use the consumable material through calculating, each time the cutter performs the cutting of the print medium, the estimated use amount of the consumable material that is estimated to be used until the cutter performs the subsequent cutting of the print medium.

3. The image forming apparatus according to claim 2, wherein the controller determines, each time the cutter performs the cutting of the print medium, whether the image forming section is able to use the consumable material until the image forming section completes the image formation for the subsequent section page group.

4. The image forming apparatus according to claim 3, further comprising a notifying section that prompts a user to replace the consumable material when the controller determines that the image forming section is not able to use the consumable material.

5. The image forming apparatus according to claim 2, wherein the print data includes image data, the controller performs a predetermined image process on a basis of the image data, and the image forming section performs the image formation on a basis of image data on which the predetermined image process has been performed by the controller.

6. The image forming apparatus according to claim 1, wherein the controller determines whether the image forming section is able to use the consumable material through calculating, before the image forming section starts the image formation, the estimated use amount on the basis of the section page group as the unit.

7. The image forming apparatus according to claim 6, wherein the controller calculates a cuttable time number when the controller determines that the image forming section is to be not able to use the consumable material before the image forming section completes the image formation related to all pages included in the print data, the cuttable time number being number of times that the cutter is able to cut the print medium before the image forming section becomes not able to use the consumable material.

8. The image forming apparatus according to claim 7, further comprising a notifying section that notifies a user of the cuttable time number.

9. The image forming apparatus according to claim 6, wherein the print data includes image data, the controller performs a predetermined image process on a basis of the image data before the image forming section starts the image formation, and the image forming section performs the image formation on a basis of image data on which the predetermined image process has been performed by the controller.

10. The image forming apparatus according to claim 1, wherein, when the print data includes control information related to the cutting of the print medium, the controller calculates, on the basis of the print data, the estimated use amount, and determines, on a basis of the estimated use amount and the usable amount, whether the image forming section is able to use the consumable material.

11. The image forming apparatus according to claim 1, wherein the image forming apparatus has a first operation mode and a second operation mode, the controller determines, in the first operation mode, whether the image forming section is able to use the consumable material through calculating, each time the cutter performs the cutting of the print medium, the estimated use amount of the consumable material that is to be used until the cutter performs the subsequent cutting of the print medium, and the controller determines, in the second operation mode, whether the image forming section is able to use the consumable material through calculating the estimated use amount on the basis of the section page group as the unit before the image forming section starts the image formation.

12. An image forming method comprising:

cutting, with a cutter, a print medium on a basis of a cutting position;

calculating, with a controller, on a basis of print data, an estimated use amount on a basis of a section page group as a unit, the estimated use amount being an amount of a consumable material that is estimated to be used, the section page group being a page group, of the print medium, sectioned in accordance with the cutting position;

determining, on a basis of the estimated use amount and a usable amount, whether an image forming section is able to use the consumable material, the usable amount being a remaining amount of the consumable material that is usable; and performing, with the image forming section, image formation on the print medium with use of the consumable material on the basis of the print data.

* * * * *